US007142683B1

(12) United States Patent
Markow et al.

(10) Patent No.: US 7,142,683 B1
(45) Date of Patent: Nov. 28, 2006

(54) COMPUTER WITH ACOUSTIC DRIVER BUILT INTO ACOUSTICALLY LEAKY CHASSIS

(75) Inventors: Mitchell A. Markow, Spring, TX (US); David E. Gough, Houston, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/259,852

(22) Filed: Mar. 1, 1999

(51) Int. Cl.
*H04R 1/02* (2006.01)
*H04R 9/06* (2006.01)

(52) U.S. Cl. ..... 381/333; 381/388; 381/306; 361/683; 700/94

(58) Field of Classification Search ..... 381/306, 381/333, 388; 700/94; 361/681, 682, 683
See application file for complete search history.

(56) References Cited

U.S. PATENT DOCUMENTS 5,581,621 A * 12/1996 Koyama et al. ..... 381/103
5,604,663 A * 2/1997 Shin et al. ..... 361/686
5,729,430 A * 3/1998 Johnson ..... 361/682
5,884,156 A * 3/1999 Gordon ..... 455/321
5,926,627 A * 7/1999 Sugimura ..... 710/303
6,043,976 A * 3/2000 Su ..... 361/686
6,078,497 A * 6/2000 Derocher et al. ..... 361/683
6,111,755 A * 8/2000 Park ..... 361/727
6,259,932 B1 * 7/2001 Constien ..... 455/556.1
6,304,434 B1 * 10/2001 Markow ..... 361/683
6,522,763 B1 * 2/2003 Burleson et al. ..... 381/189

OTHER PUBLICATIONS

Dimitriadis et al., "Piezoelectric Actuators for Distributed Vibration Excitation of Thin Plates", Journal of Vibration and Acoustics, vol. 113, Jan. 1991, pp. 100-107.
Sonti et al., "Equivalent Forces and Wavenumber Spectra of Shaped Piezoelectric Actuators," Journal of Sound and Vibration 187, 1995, pp. 111-130.
Komiyama et al., "Distance Control of Sound Images by a Two-dimensional Loudspeaker Array", Journal of Acoustic Society, Japan, 13, 1992, pp. 171-180.
"Quickpack Piezoelectric Actuators", ACX(Active Control Experts), Nov. 1996, 12 pages.

* cited by examiner

*Primary Examiner*—Xu Mei

(57) ABSTRACT

A desktop computer which has a driver mounted in the back wall of the chassis. The chassis is acoustically a very leaky box, so the driver is designed as if it were a free-space driver (using large cone area and long throw). In one class of embodiments, a single driver is used, and is centered in the back of the box so that there is an equal left-right split, although not true stereo. The front of the box may be made more acoustically leaky to move the acoustic image forward. The treatment of the box as being acoustically leaky means that the airflow required for thermal management has not been restricted. The use of a long-throw driver permits the volume-velocity of the driver to be increased. Treatment of the box as very leaky also means that no user changes or custom configurations will significantly disturb the expected acoustic environment. An audio system incorporating a free-space driver with an equalizer designed for use with a free-space driver further improves acoustic quality. Gain staging may also be used to improve acoustic quality of the audio system.

40 Claims, 4 Drawing Sheets

COMPUTER WITH ACOUSTIC DRIVER BUILT INTO ACOUSTICALLY LEAKY CHASSIS

BACKGROUND AND SUMMARY OF THE INVENTION

The present application relates to computers with built-in speaker systems, and particularly to single-user desktop computers.

Background: Computer-Based Audio

The production of quality sound systems for computers has advanced significantly in recent years. Early personal computers typically had nothing more than a single, small acoustic driver used to produce a beep or series of single-frequency beeps to indicate system status upon startup. Typically, no additional sound producing circuitry was included. However, consumers demanded better audio performance. With recent advances in circuit miniaturization and audio engineering, sound cards capable of excellent sound reproduction are available for desktop computers.

Background: Computer Audio Requirements

In the 1990s, multimedia systems for personal computers have been a very active area of competition between manufacturers. The consumer market strongly demands some sort of sound system, but is also very sensitive to cost.

The normal approach, as of 1998, is to ship a pair of small speakers which are connected to the computer chassis with short speaker cables. A disadvantage of using external speakers is that they force a user to find space on his desktop for them. The present inventors have recognized that it would be highly desirable to provide an economical internal high-quality "default" speaker system onto which additional component speakers can be added if desired.

Background: Acoustical Implications of Computer Chassis Constraints

The consumer-expected structure of small computers (whether desktop, minitower, single-user, and/or personal) puts some constraints on the acoustical characteristics of the computer chassis. These constraints have made it difficult to use the interior volume of the computer chassis as a sealed or ported speaker box.

One constraint is the conventional modularity of personal computers. Many consumers expect to be able to customize with add-in cards for extra functions. Many manufacturers and assemblers also find this flexibility invaluable.

The conventional form factor for a PC chassis, which derives from the IBM personal computers of the 1980s, is difficult to make acoustically sealed. Moreover, because the consumer or assembler can be expected to open the chassis for card insertions, it is possible that one of the covers over the openings for external card connections might be left off; this would drastically change the acoustical characteristics of a sealed chassis.

Another constraint is the airflow requirement for cooling. In configurations with a high-speed microprocessor and maximum hard-drive capacity, airflow through the chassis interior may be required for cooling. It is difficult to accommodate this airflow while acoustically sealing the chassis.

A further constraint is that some mass-storage devices, such as hard drives and CDROM drives, may be very sensitive to vibration. Too much vibration could cause the disk heads to skip or crash. Some earlier computer designs in which a driver was mounted in the front of the chassis were found to cause skipping in CDROM drives.

Background: Spatial Impression

The design of sound reproduction systems is not only based on considerations of electrical/acoustical engineering and physics, but also requires knowledge of psychoacoustics, i.e. how sound is perceived by listeners.

One of the parameters of psychoacoustics is spatial impression. Spatial impression is a term used to in acoustics to define a listener's perception of fullness, width, and impression of being in a three-dimensional space. A listener's perception of the size of a room is influenced by the relationship between direct and indirect (reflected) sound. When a sound is generated in the room, the listener will first hear the sound via the most direct path from the source. Shortly thereafter, the listener will hear the reflections of the sound from surfaces such as walls or ceilings.

Human listeners will assess the size of the space they are in by listening to laterally reflected sound which accompanies a sound signal. A more roomy spatial impression is welcome to many listeners. Thus, in a loudspeaker system it is desirable to have some sound transmission paths which reach the ears of the listener with a certain amount of delay (e.g. 10–60 milliseconds) as compared with the direct transmission path. This delay will give the impression of a spacious listening room by broadening the soundstage, and also by giving the illusion of pushing the sound beyond the physical location of the speakers, even if the listener is listening in a room which is very small.

Another peculiarity of spatial impression is that low frequencies (below 500 Hz) have a disproportionately greater effect on spatial impression than frequencies above 500 Hz. However, it is not easy to produce low frequencies at an acceptable power level with a small speaker system.

To increase spatial impression, the ratio of laterally reflected energy to directly transmitted energy can be increased: the higher this ratio, the greater the spatial impression. An extreme case of this is found in a symphony concert hall, where most sound has been reflected before reaching the listener.

Whether the user is video-conferencing, playing a game, or just working with music in the background, spatial impression plays an important role in the computing experience. That role is growing ever more important as multimedia makes its way further into the business and gaming environments.

Further background regarding spatial impression can be found in: J. Blauert, Spatial Hearing (2.ed. 1996); and in M. Barron, "Effects of Early Reflections on Subjective Acoustic Quality in Concert Halls" (thesis, University of Southampton, 1974); both of which are hereby incorporated by reference.

Background: Stereophonic and Surround Sound

Since its introduction in the 1950's, stereo has been regarded as an essential minimum requirement of quality sound reproduction. By splitting the audio signal into right and left channels, stereo tries to simulate a traditional soundstage such as that experienced when one attends a play or concert. However, even stereo has shortcomings when required to accurately simulate a setting where the sound is heard from all around the listener. Stereo's lack of spatiality undermines sonic realism in, for example, a game where aircraft fly overhead from front to back, or footsteps come from off to the side. To heighten sonic realism various "surround sound" schemes have been used to provide at least some speaker output behind the listeners' positions.

Background: Dynamic Speakers

The heart of a loudspeaker is the motor structure that drives the diaphragm or cone. One simple way to generate the motion in a speaker is with a dynamic transducer. This is basically a linear transducer, in which a movable diaphragm (or "cone") is attached to a coil which is driven by a variable current. The coil is suspended in a constant magnetic field. The current through the coil interacts with the magnetic field to generate a force, which makes the coil and diaphragm oscillate according to the current variations through the coil. Motion of the diaphragm will generate two acoustic outputs: a frontwave output from one side of the moving diaphragm, and a backwave output from the other side.

One fundamental decision in a loudspeaker design is what to do with the backwave so that it will not interfere with the sound of the frontwave. A classic solution is to completely swallow the backwave in the confines of a sealed enclosure; this is known as an "acoustic suspension" speaker. Another popular solution is to route some of the bass backwaves back toward the listening area through a vent. This is known as a "bass reflex" design. Still another method is to use a passive radiator, or a "drone" driver, which passively vibrates with energy from inside the cabinet, not with direct signal from the crossover. All these methods have advantages, especially if the drivers and enclosures are carefully designed.

The response of an assembled loudspeaker is normally quite different from that of an individual driver standing alone (a free-space driver). With a normal free-space driver there will be substantial cancellation at mid and lower frequencies because the back of the driver is approximately the same area as the front of the driver and is radiating at a phase which is exactly 180 degrees out of phase with the acoustic radiation from the front of the speaker. Thus a great deal of engineering effort has been put into designing speakers for optimal loading of the electromechanical driver to produce the desired response. For instance, in an acoustic suspension speaker, the driver is simply mounted in a closed box that provides capacitive loading and damping for the driver's motion. FIG. 4 shows a typical prior art acoustic suspension speaker. A driver 410 consisting essentially of a cone 420 and an electro-acoustic transducer 430 is mounted in a sealed box 440. The walls of the box may be covered with an acoustic damping material 450. The arrangement shown in FIG. 4 is power inefficient because the driver has to push against air in a sealed box, but it does reduce interference between frontside radiation and backside radiation.

Many other speakers use ports and acoustic loading elements which are tuned to include one or more resonances, with the ultimate objective of improving the speaker's power efficiency, linearity, and frequency range. However, a free-space speaker requires different techniques to achieve those objectives.

Background: Wall-Effect

Spatial imaging is a great concern in audio technology. Spatial imaging can often be enhanced by bouncing audio signals off of reflective surfaces toward a listener such that there is a slight time delay between the reflected waves and waves beamed straight at the listener. These reflectors are generally rigid surfaces such as walls (hence the name wall-effect or corner-effect).

In many speaker systems, reflected waves are ignored in favor of the strategy of beaming the audio wave directly at a listener, resulting in a flat sound with no audio depth. Reflected audio waves from a musician's live performance add to the richness of the listening experience but these reflected waves are not present when an audio wave from a recording is beamed directly at the listener. Utilizing the wall-effect allows for a more "real-world" representation of sound because it simulates the reflected waves that would be present from a "live" event.

Background: Baffles

A baffle can be thought of as a plane wall that does not allow sound to pass through it. Some speakers are commonly modeled as a piston (driver) placed in the center of such a plane wall so that the frontwave and backwave are separated by the plane wall. The effect of the baffle is to prevent front and backwaves from interfering with each other.

A finite baffle which extends around the driver over a minimum radius which is larger than the lowest wavelength of interest will have the practical effect of decoupling the frontwave and backwave. However, as the baffle radius around the driver becomes smaller in relation to a wavelength, interference between front and backwaves at that wavelength becomes greater.

An acoustic-suspension arrangement is sometimes referred to as an "infinite baffle," because the backwave is effectively eliminated. The acoustic-suspension solution comes at the cost of increased power consumption to overcome air compression in the sealed box. An additional disadvantage of the sealed box is that increased thermal dissipation may be needed to offset heat caused by increased power consumption in the driver.

Background: Sound Image

Distance perception is a fairly difficult area of psychoacoustics: see Blauert at 116–137. However, in the case where the loudspeakers are focused to produce an intensity maximum somewhere outside the listener's head (e.g. in front of the listener), the listener will often identify the spatial location of the intensity maximum as the apparent source of the sound. In such cases the intensity maximum will define the apparent origin of a "sound image." See Hartmann, "Sounds in space, sounds in your head, and sounds in between," Proceedings of 1997 Workshop on Applications of Signal Processing TO Audio and Acoustics 1 (1997); Komiyama et al., "Distance control of sound images by a two-dimensional loudspeaker array," 13 J. Acoustical Soc. Japan (E) 171 (1992); both of which are hereby incorporated by reference. (Such a sound image can be thought of as a very simple case of acoustic holography.)

One of the more subtle psychoacoustic criteria for sound reproduction arises from the existence of such sound images. If a sound image location is too close to the listener's position, many listeners will feel a psychological discomfort which is analogous to the discomfort felt when another person talks too close to one's face. Generally, a preferred location for the sound image relative to the listener is approximately 12–24 inches in front of the listener's face, with 18–24 inches being more desirable. A possible exception to this "comfortable distance" concept is with the use of headphones, where an "inside the head effect" may be desirable.

Background: Driver Design

Audio scientists try to optimize drivers for the environment (such as free-space or baffled) in which they will be used. Typical design choices are coil size, magnetic gap, heat sinking, cone size, cone shape, overhang, and throw length. A driver designed for free-space operation generally will be engineered for a longer throw than one designed for use in an acoustic suspension box. A longer throw generates a larger volume-velocity to make up for sound cancellation due to interference between the frontwave and backwave. The throw of an acoustic suspension driver, on the other hand, is restricted due to air compression in the sealed box.

One drawback of using a speaker designed for sealed enclosures in an acoustically leaky chassis is that the voice coil will move outside the magnetic field (in other words, the coil has more excursion than it was designed to accommodate because the expected backside pressure is not present). This excess excursion will result in harmonic distortion. Additionally, in comparison to speakers designed for free space operation, speakers designed for sealed boxes are generally 7 to 10 dB down when put in a leaky chassis.

Computer with Speaker in Acoustically Leaky Chassis

The present application discloses a desktop computer model which has a driver mounted in the back side of the chassis. The chassis is acoustically a very leaky box, so the driver is designed as if it were a nearly freestanding driver. (That is, the driver is given a larger cone area and/or longer throw than would otherwise be required for a given sound pressure level at a given low-frequency limit.) Acoustic leakage through the front of the chassis helps to move the acoustic image forward by moving the intensity maximum forward.

The treatment of the box as being acoustically leaky means that the airflow required for thermal management has not been restricted. Because the budget for internal volume is fairly large, the driver can be large. A large cone size combined with the use of a long-throw driver permits the volume-velocity of the driver to be increased, thus increasing sound power at low frequencies. Treatment of the box as very leaky also means that no user changes or custom configurations will significantly disturb the expected acoustic environment.

The rear-firing speaker helps to keep the acoustic image moved somewhat to the rear, i.e. out of the user's face, and also helps to improve spatial ambience by increasing the ratio of reflected to direct sound. However, front-side leakiness of the box provides some acoustic emission toward the front, which is also advantageous.

Thus the present application teaches that the driver is preferably designed for operation in "free-space." This is a different direction of improvement than has been conventionally followed: previous attempts used a driver mounted within the computer while treating the computer box, or a sub-box inside the computer chassis, as a loudspeaker box. Instead, the present invention tolerates or even increases the acoustic leakiness of the computer chassis.

The present invention is most advantageous in nonportable small computer systems (e.g. desktop or minitower systems). Power efficiency and volume are less tightly constrained in desktop systems than in portable computers. An audio system that does not interfere with modularity, ease of chassis assembly, and ease of maintenance is an advantage in desktop systems.

A particular advantage of an acoustically leaky chassis with a back-mounted driver is that the acoustic transmission through the front of the computer will provide a deeper soundstage and more of an impression of depth to the user.

In an alternate (perhaps superior) embodiment, an audio system is comprised of an acoustically leaky computer chassis, an equalizer, electrical gain staging, and a driver designed for nearly free-space operation. The equalizer may have predetermined equalization stages designed to work with a free-space driver. Of course, as discussed above, the equalizer and electrical gain staging are not necessary to practice the invention in the preferred embodiment.

BRIEF DESCRIPTION OF THE DRAWINGS

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

Figure 1:
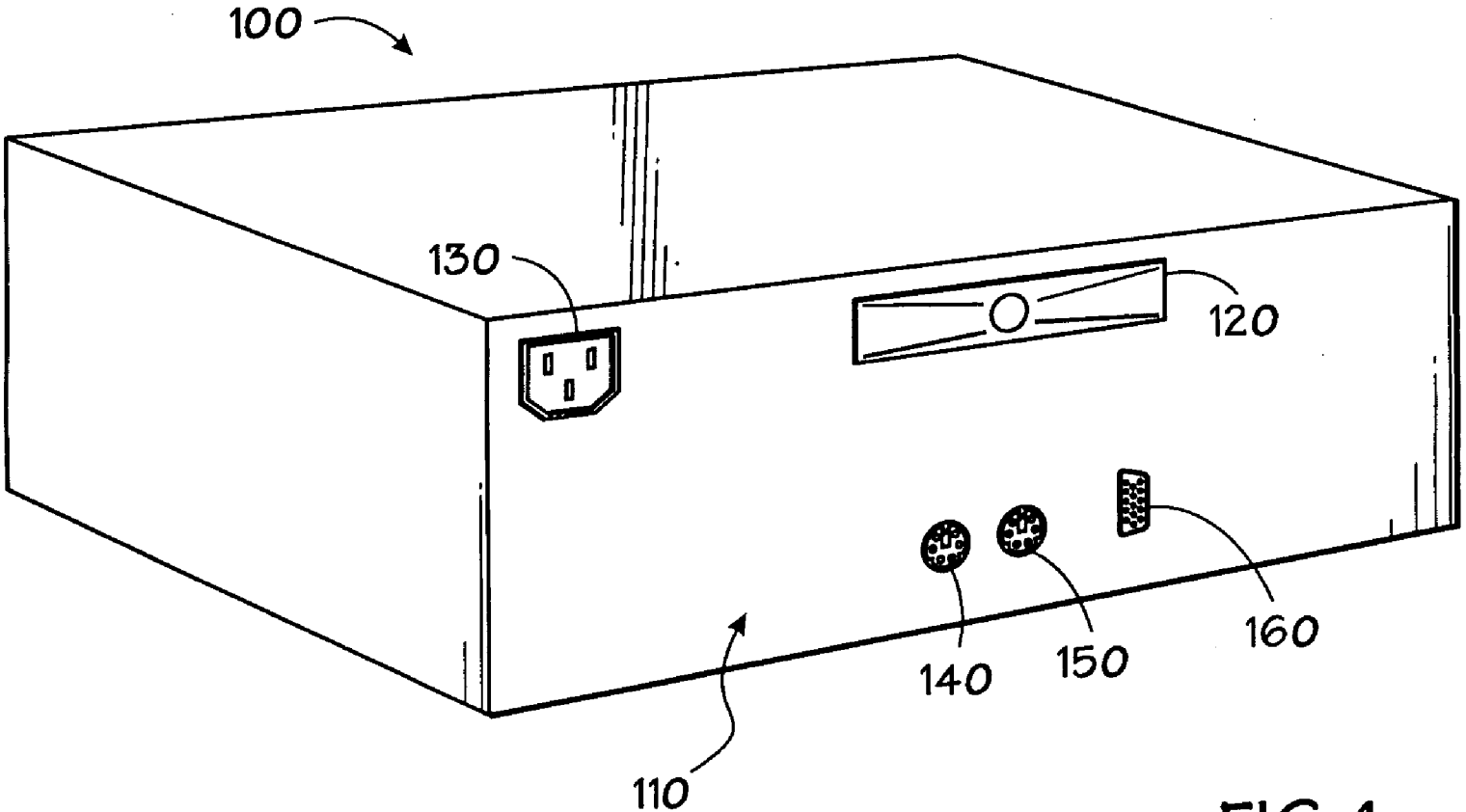
FIG. 1 shows a sample computer system according to the presently preferred embodiment.

The numerous innovative teachings of the present application will be described with particular reference to the presently preferred embodiment. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

DEFINITIONS

Following are short definitions of the usual meanings of some of the technical terms which are used in the present application. (However, those of ordinary skill will recognize whether the context requires a different meaning.) Additional definitions can be found in the standard technical dictionaries and journals.

Acoustic Impedance: Quotient of the sound pressure at a surface by the volume-velocity through the surface. It is generally a complex quantity (having real and imaginary components) in the frequency domain.

Acoustically Leak Chassis: A chassis that has an acoustic impedance magnitude less than half what it would have if sealed such that it would function as an acoustic suspension box.

Backwave: After a driver compresses air forward toward a listener, the cone direction of travel reverses and another longitudinal wave known as the backwave is fired in the opposite direction from the forward wave, 180 degrees out of phase with the forward wave. One of the main functions of a conventional speaker enclosure is to manipulate or absorb this backwave.

Baffle: See background section above.

Bass Reflex: A speaker enclosure with a port that functions as a Helmholtz resonator. The ported box forms a tuned mechanical-acoustic resonator in which a moving mass resonates against an acoustic compliance.

Driver: An electro-acoustic transducer. A transducer that changes electrical energy into vibration, thereby producing pressure waves in air. Sometimes referred to as a motor or loudspeaker by audio engineers.

Free-space driver: A driver designed for operation without a baffle.

Frontwave (Forward Wave): As a driver cone compresses air forward toward a listener, it initiates a longitudinal (sound) wave known as a frontwave.

Helmholtz Resonator: A tuned acoustical resonator. The resonant frequency for any Helmholtz resonator is determined by the compliance of the air in the container and the mass of the air in the port. At the Helmholtz resonant frequency, the air in the port vibrates easily, compressing and decompressing the air in the container. An empty soda bottle acts as a Helmholtz resonator when air is blown across its open mouth.

Long-throw driver: A driver with a throw length greater than ten percent of its minimum cone diameter. A driver with a cone radius of 90×50 millimeters has a minimum diameter of 50 mm and therefore would be a long-throw driver if it had a throw greater than 5 mm.

Quality Factor ($Q_{TS}$): Quality factor of the driver at resonant frequency in free-space.

Speaker: Generally refers to a driver and its enclosure.

Volume-velocity: the volume of air displaced by a diaphragm per unit time.

Overview

The present application discloses a desktop computer model which has a driver mounted in the back side of the chassis. The chassis is acoustically a very leaky box, so the driver is designed as if it were a free-space driver (using large cone area and long throw). In a preferred embodiment, the driver is a dynamic driver with eight millimeters of throw and a cone area of 90×50 millimeters. In the preferred embodiment, the driver is centered in the back of the box so that there is an equal left-right split, although not true stereo. The front of the box is normally somewhat acoustically leaky, and this helps to move the acoustic image forward. In future embodiments, it is contemplated that the front of the box may be made more leaky, e.g., by adding perforations or a grill.

By treating the chassis as acoustically leaky, the airflow required for thermal management has not been restricted. The budget for internal volume is fairly large so that the driver can be large. In fact, the use of a long-throw driver permits the volume-velocity of the driver to be increased. The treatment of the box as very leaky also means that no user changes or custom configurations will significantly disturb the expected acoustic environment.

The power budget for the preferred embodiment of this rear driver is 5 or 6 watts, but this is not critical. The driver is preferably mounted on rubber grommets, for mechanical isolation in the chassis. (This helps to avoid skipping in the disk drives).

The rear-firing speaker helps to keep the acoustic image moved somewhat to the rear, i.e. out of the user's face, and also helps to improve spatial ambience by increasing the ratio of reflected to direct sound. However, the leakiness of the chassis provides some acoustic emission toward the front, which is also advantageous.

Sample Embodiment

FIG. 1 shows a sample computer system according to the presently preferred embodiment. A rear view of computer system 100 shows a back panel 110 comprising a rear-firing acoustic driver designed for free-space operation 120, a power connector 130, a keyboard connector 140, a mouse connector 150, and a display connector 160. The driver 120 preferably has a $Q_{TS}$ in the range of 0.65 to 0.8.

Figure 2:
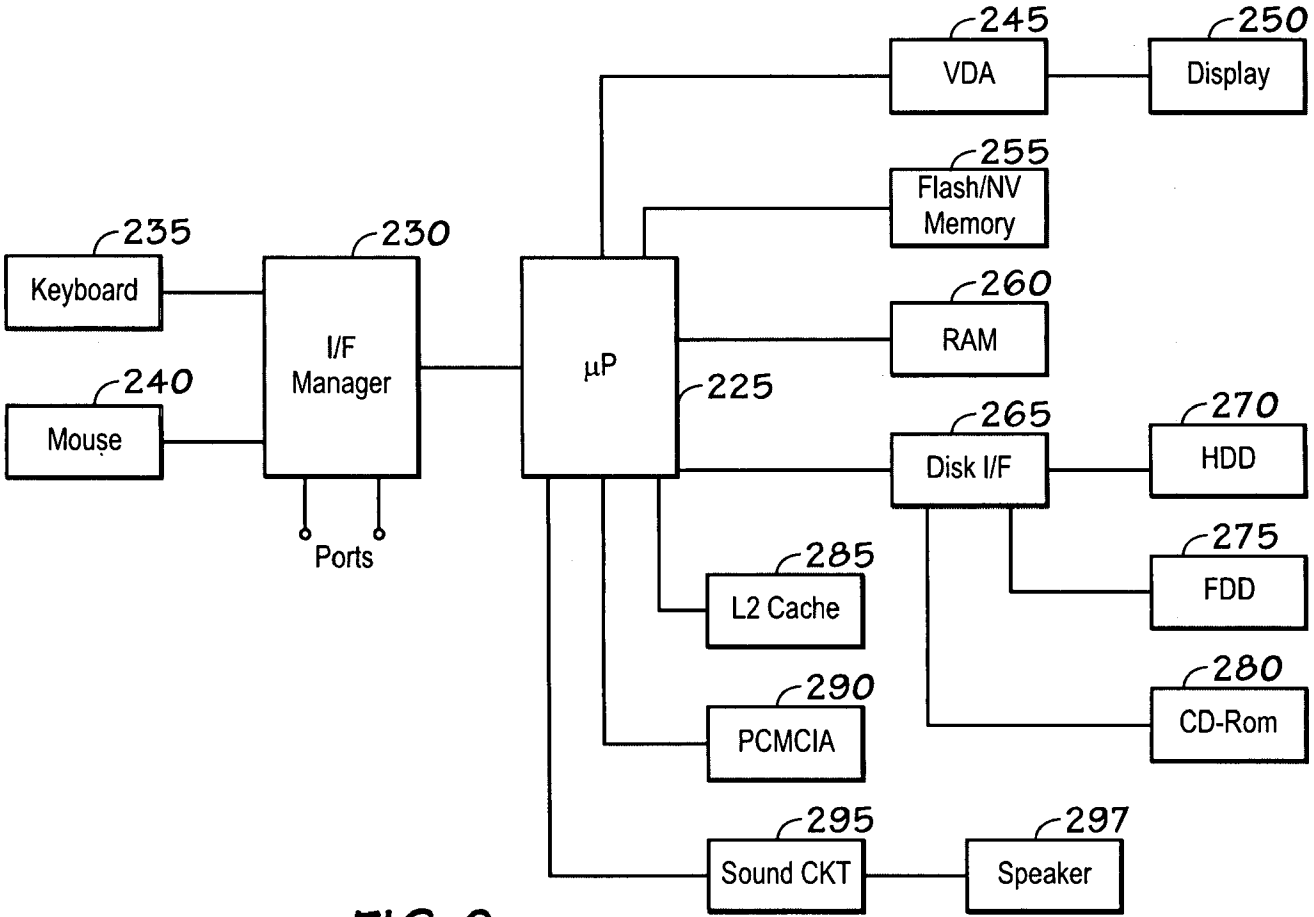
FIG. 2 shows a block diagram of the electrical organization of a sample computer system according to the presently preferred embodiment.

FIG. 2 shows a block diagram of the electrical organization of a sample computer system according to the presently preferred embodiment. The computer system includes in this example: user input devices (e.g. keyboard 235 and mouse 240); at least one microprocessor 225 which is operatively connected to receive inputs from said input device, through an interface manager chip 230 (which also provides an interface to the various ports); a memory (e.g. flash or non-volatile memory 255 and RAM 260), which is accessible by the microprocessor; a data output device (e.g. display 250 and video display adapter card 245) which is connected to output data generated by the microprocessor 225; a magnetic disk drive 270 which is read-write accessible, through an interface unit 265, by the microprocessor 225: and a sound system comprising a sound circuit 295 driving a speaker system 297.

Optionally, of course, many other components can be included, and this configuration is not definitive by any means. For example, the computer may also include a CD-ROM drive 280 and floppy disk drive ("FDD") 275 which may interface to the disk interface controller 265. Additionally, L2 cache 285 may be added to speed data access from the disk drives to the microprocessor, and a PCMCIA 290 slot accommodates peripheral enhancements.

Figure 3:
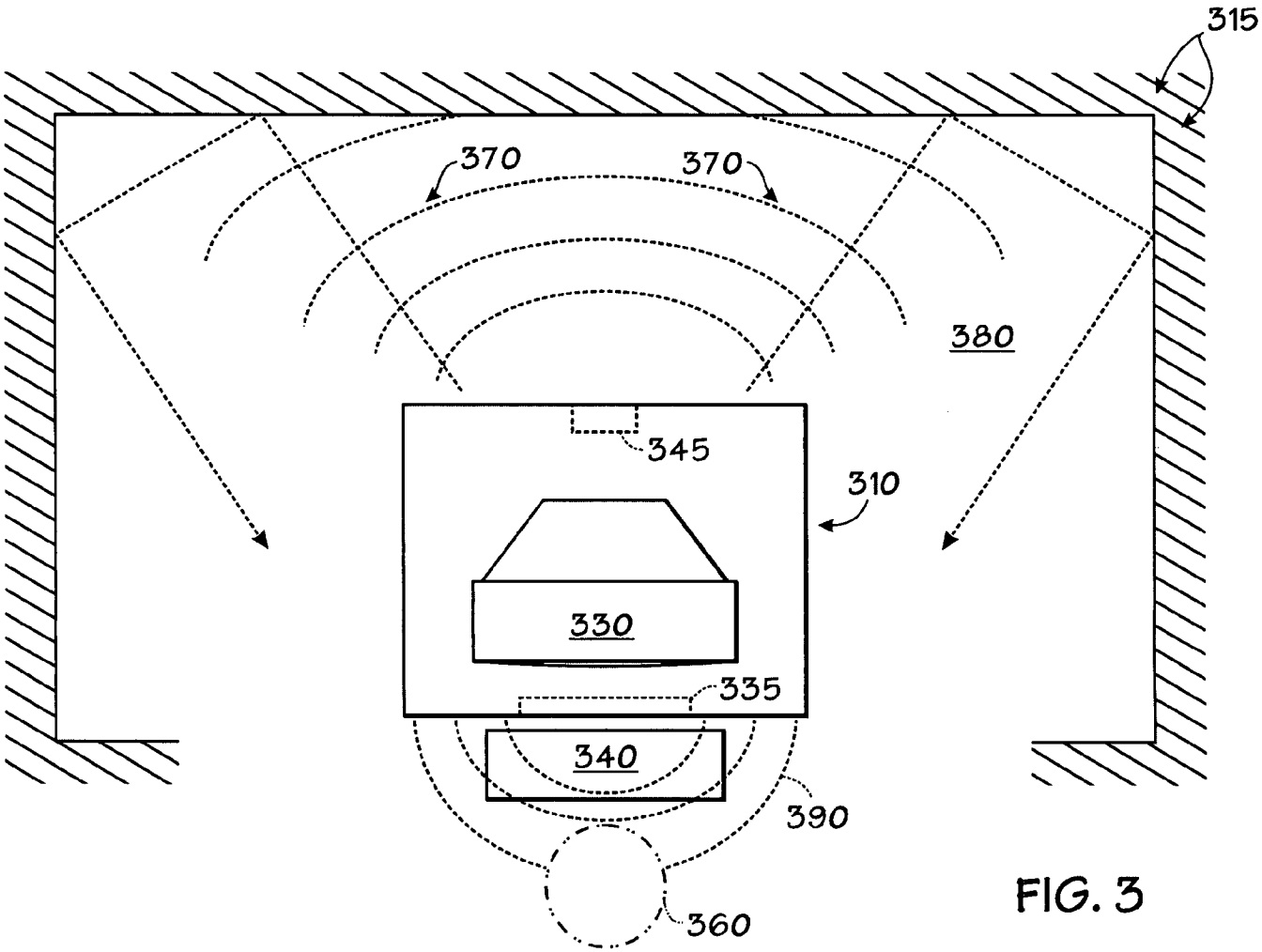
FIG. 3 depicts an embodiment of the present invention utilizing the wall-effect.
Figure 4:
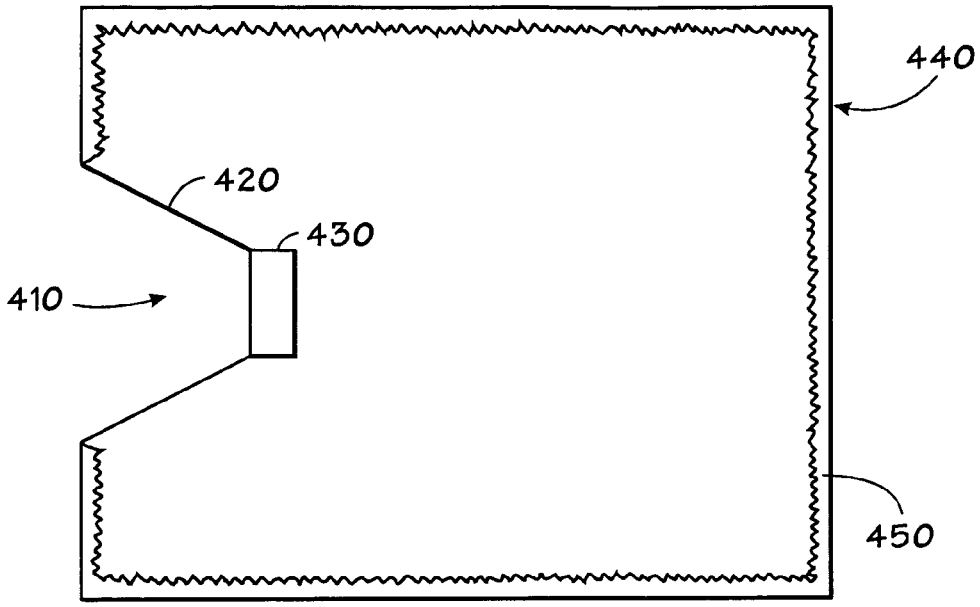
FIG. 4 shows an acoustic suspension (sealed box) driver.

FIG. 3 shows a top-down view of reflected sound path from a speaker system incorporating a driver mounted in the rear wall of a desktop computer. The computer is positioned on a surface 380 with display 330 on top of computer chassis 310 situated for viewing by the listener (of course the display may be located elsewhere). When a listener is seated approximately in front of the computer chassis 310, for use of the computer keyboard 340 and display 330, the listener's head can be expected to be located in the volume 360. A driver 345 designed for free-space operation is mounted in the rear wall of chassis 310 to provide rear-firing sound waves 370 which are reflected (in this example) off of vertical surfaces 315 and horizontal surface 380, back to the listener. (The surfaces 315 and 380 are part of the user's work environment, so their position is not known a priori.) Optionally, perforations 335 in the front wall of the chassis 310 provide direct-path audio to the listener. The combination of the reflected sound waves 370 and the direct sound waves 390 provides improved spatial impression to the listener. The chassis 310 preferably has an acoustic impedance less than half that of an acoustic suspension box of the same dimensions.

Figure 5:
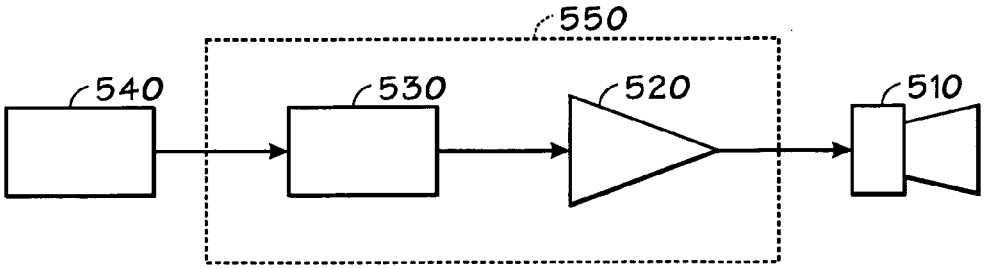
FIG. 5 shows an audio system, incorporating the present invention.

FIG. 5 shows a block diagram of an audio system incorporating the present invention. A sound source 540 provides a signal to equalizer 530. An equalized signal is input to amplifier 520. Amplifier 520 powers driver 510. Equalizer 530 and/or amplifier 520 may be incorporated in a sound card 550.

In the embodiment shown, driver 510 is designed for free-space operation and a resonance below 110 Hz. Its magnet is extra large to provide high output and a tight, controlled bass response. Driver 510 has a 90 mm×50 mm cone and an excursion of 8 mm.

Equalizer 530 acoustically "tunes" the computer chassis to its acoustic environment. In the embodiment shown, six stages of fixed equalization are used to "shape" the system frequency response, control the front-to-back image, and enlarge the spatial impression. The system frequency response is manipulated to provide smooth, natural voice reproduction and high quality CD playback.

Amplifier 520, in the embodiment shown, is rated at 5 Watts RMS and designed to deliver clean audio output. An additional heatsink may be added to amplifier 520 to improve long term and transient performance.

Gain staging is the process of amplifying or attenuating an audio signal through audio circuitry (up to an din including the driver 510) in each of the "stages" through which the signal passes. Its purpose is to avoid distorting the audio signal. Gain staging can be important in transforming driver 510, amplifier 520, equalizer 530, and sound source 540 into a unified audio system. Gain staging allows compensation for the different input levels that are generated by different sound sources 540, such as CD-ROM players, wavetables, and speakerphones. With proper gain staging, amplifier 520 output is improved for all of the various sound sources 540, thereby allowing a listener to enjoy loud, clear, undistorted sound from driver 510.

According to a disclosed class of innovative embodiments, there is provided: A computer system comprising: a chassis that encloses at least one microprocessor connected to execute application software as selected by a user, said chassis having a rear wall which faces away from a user during normal use; and an electro-acoustic transducer mounted in said chassis; wherein said transducer is designed for free-space operation.

According to another disclosed class of innovative embodiments, there is provided: A computer system, comprising: at least one input device and at least one output device; a main system module which does not include said input and output devices, and which includes therein: at least one microprocessor which is operatively connected to detect inputs from said input device and to send data to said output device, and random-access memory which is connected to be read/write accessible by said microprocessor; a bus connected to said main system module, and having connections through which additional modules can communicate with said main system module; and said main system module being mounted in a chassis which has a rear wall which faces away from a user in normal use; and a driver mounted in said chassis; wherein said driver is a free-space driver.

According to another disclosed class of innovative embodiments, there is provided: A method of operating a computer system, comprising the steps of: (A) executing application software in one or more programmable processors which are contained within a chassis, said chassis having a rear wall that faces away from a user during normal use; and meanwhile (B) providing at least one audio output to power at least one driver mounted to said chassis, said driver being designed for free-space operation.

According to another disclosed class of innovative embodiments, there is provided: An audio system, comprising: an acoustically leaky computer chassis, having a rear wall; and a driver; wherein said chassis has an acoustic impedance magnitude, as seen by said driver, of less than half that of an acoustic suspension box of the same dimensions; and wherein said driver is mounted in said rear wall.

According to another disclosed class of innovative embodiments, there is provided: A speaker, comprising: a computer chassis; and a driver mounted to said chassis; wherein said driver has a throw length greater than ten percent of its minimum cone diameter.

MODIFICATIONS AND VARIATIONS

As will be recognized by those skilled in the art, the innovative concepts described in the present application can be modified and varied over a tremendous range of applications, and accordingly the scope of patented subject matter is not limited by any of the specific exemplary teachings given.

In one class of alternative embodiments it is contemplated that the front of the computer chassis is perforated to increase its acoustic leakiness, thereby moving the acoustic image forward.

Additional general background, which helps to show the knowledge of those skilled in the art regarding the system context, and of variations and options for implementations, may be found in the following publications, all of which are hereby incorporated by reference. In particular, many details may be found in: Douglas J. Button, A Loudspeaker Motor Structure for Very High Power Handling and High Linear Excursion, Journal of the Audio Engineering Society, vol. 36, no. 10, pp. 788–796 (October 1988); John Borwick, Loudspeaker and Headphone Handbook, Focal Press (1997); J. Ernest Benson, The Theory and Design of Loudspeaker Enclosures, (1993); David Weems, Building Speaker Enclosures, TAB Books (1984); Abraham Cohen, Hi-Fi Loud-speakers and Enclosures, Hayden Book Company (1968); and Martin Colloms, High Performance Loudspeakers, John Wiley & Sons (1980).

Although the preferred embodiment discloses a rear-firing speaker exploiting the wall-effect, the driver does not have to be located on the rear wall to take advantage of the wall-effect. Other locations, such as the right and/or left sides of the chassis, are possible alternatives.

Although the preferred embodiment discloses a driver centered in the back of the box so that there is an equal left-right split, the driver may be placed at any appropriate location in the chassis.

Although the preferred embodiment discloses a dynamic driver with eight millimeters of throw and a cone area of 90×50 millimeters, it is obvious to one skilled in the art that drivers for free-space operation can be designed with other appropriate dimensions.

What is claimed is:

1. A computer system comprising:

a chassis that encloses at least one microprocessor, said chassis having a rear wall with an outer face which faces away and opposite from a user during normal use; and an electro-acoustic transducer mounted in said chassis, wherein said transducer is mounted to said rear wall, wherein said chassis has an acoustic impedance magnitude, as seen by said transducer, of less than half that of an acoustic suspension box of the same dimensions.

2. The computer system of claim 1, wherein said transducer is mounted to the center of said rear wall.

3. The computer system of claim 1, wherein said chassis has a front wall with an outer face that faces a user during normal use; and wherein said front wall has perforations, whereby said front wall is made more acoustically leaky.

4. The computer system of claim 1, wherein said transducer utilizes the wall-effect, whereby acoustic spatial impression is improved.

5. The computer system of claim 1, wherein said transducer has a $Q_{TS}$ in the range of 0.65 to 0.8.

6. The computer system of claim 1, wherein said transducer is a long-throw transducer.

7. The computer system of claim 1, further comprising a sound card.

8. The computer system of claim 1, further comprising at least one external speaker.

9. A computer system, comprising:

at least one input device and at least one output device;

a main system module which includes therein: at least one microprocessor operatively connected to detect inputs from said input device and to send data to said output device, and random-access memory connected to be read/write accessible by said microprocessor;

said main system module being mounted in a chassis which has a rear wall having an outer face which faces away and opposite from a user in normal use; and a driver mounted in said chassis, wherein said driver is mounted to said rear wall, wherein said chassis has an acoustic impedance magnitude, as seen by said driver, of less than half of that of an acoustic suspension box of the same dimensions.

10. The computer system of claim 9, wherein said driver has a $Q_{TS}$ in the range of 0.65 to 0.8.

11. The computer system of claim 9, wherein said driver utilizes the wall-effect, whereby acoustic spatial impression is improved.

12. The computer system of claim 9, wherein said driver is mounted to the center of said rear wall.

13. The computer system of claim 9, wherein said driver is a long-throw driver.

14. A method of operating a computer system, comprising executing application software in one or more programmable processors contained within a chassis, said chassis having a rear wall with an outer face which faces away and opposite from a user during normal use, wherein said driver is mounted in said rear wall, wherein said chassis has an acoustic impedance magnitude, as seen by said driver, of less than half that of an acoustic suspension box of the same dimensions; and providing at least one audio output to power at least one driver mounted to said chassis.

15. The method of claim 14, wherein said driver is mounted to the center of said rear wall.

16. The method of claim 14, wherein said driver has a $Q_{TS}$ in the range of 0.65 to 0.8.

17. The method of claim 14, further comprising the step of equalizing an audio signal and providing said signal to said audio output.

18. The method of claim 17, wherein said equalizing step is performed to work in context with a free-space driver.

19. The method of claim 14, wherein said chassis has a front wall with an outer face that faces a user during normal use, said front wall having perforations, whereby said front wall is made more acoustically leaky.

20. The method of claim 14, wherein said driver utilizes the wall-effect, whereby acoustic spatial impression is improved.

21. An audio system, comprising:

an acoustically leaky computer chassis, having a rear wall; and a driver;

wherein said chassis has an acoustic impedance magnitude, as seen by said driver, of less than half that of an acoustic suspension box of the same dimensions; and wherein said driver is mounted in said chassis to said rear wall.

22. The audio system of claim 21, further comprising an equalizer.

23. The audio system of claim 22, wherein said equalizer has at least one predetermined stage of fixed equalization for enlarging spatial impression.

24. The audio system of claim 22, further comprising gain staging.

25. The audio system of claim 22, wherein said equalizer equalizes an audio signal as if said driver were standing in free space.

26. The audio system of claim 22, wherein said equalizer modifies an audio signal to simulate a predetermined acoustic environment when said signal is played through said driver.

27. The audio system of claim 21, further comprising a sound source.

28. The audio system of claim 27, wherein said sound source is a CD player.

29. The audio system of claim 27, wherein said sound source is a wave table.

30. The audio system of claim 27, wherein said sound source is a speakerphone.

31. The audio system of claim 27, further comprising gain staging.

32. The audio system of claim 21, further comprising a sound card.

33. The audio system of claim 32, further comprising gain staging.

34. The audio system of claim 21, wherein an apparent origin of a sound is created in a range of 12 to 24 inches in front of listener's face.

35. The audio system of claim 21, further comprising at least one external speaker.

36. A system, comprising:

a computer chassis that encloses at least one microprocessor; and a driver mounted in said chassis to a rear wall thereof with said driver facing away and opposite from a user during normal use, wherein said chassis has an acoustic impedance magnitude, as seen by said driver, of less than half that of an acoustic suspension box of the same dimensions;

wherein said driver has a throw length greater than ten percent of its minimum cone diameter.

37. The system of claim 36, wherein said driver is a free-space driver.

38. The system of claim 36, wherein said chassis has a front wall, said front wall having an acoustic vent.

39. The system of claim 36, wherein said driver is mounted to the middle of said rear wall.

40. The system of claim 36, wherein said driver has a $Q_{TS}$ in the range of 0.65 to 0.8.

* * * * *